US012747655B1

(12) United States Patent
Novelen et al.

(10) Patent No.: US 12,747,655 B1
(45) Date of Patent: Sep. 29, 2026

(54) SHAPE MEMORY FOAM SCREEN IN CONJUNCTION WITH SHROUDED OVER DEFORMABLE CHAMBERS FOR WELLBORE COMPLIANCE

(71) Applicant: Halliburton Energy Services, Inc., Houston, TX (US)

(72) Inventors: Ryan Novelen, Euless, TX (US); Stephen Greci, Little Elm, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 19/244,918

(22) Filed: Jun. 20, 2025

(51) Int. Cl.
*E21B 43/10* (2006.01)

(52) U.S. Cl.
CPC ..... *E21B 43/108* (2013.01)

(58) Field of Classification Search
CPC ..... E21B 43/103; E21B 43/108; E21B 43/082
See application file for complete search history.

(56) References Cited

U.S. PATENT DOCUMENTS

| | | | | |
|---|---|---|---|---|
| 6,766,862 | B2 | 7/2004 | Chatterji et al. | |
| 8,528,640 | B2 | 9/2013 | Agrawal | |
| 2004/0261994 | A1* | 12/2004 | Nguyen | E21B 43/103 166/227 |
| 2005/0067170 | A1* | 3/2005 | Richard | E21B 33/134 166/387 |
| 2005/0205263 | A1* | 9/2005 | Richard | E21B 43/108 166/227 |
| 2010/0089565 | A1 | 4/2010 | Duan et al. | |
| 2011/0067872 | A1* | 3/2011 | Agrawal | E21B 43/082 166/302 |
| 2011/0073296 | A1 | 3/2011 | Richard et al. | |
| 2012/0145389 | A1 | 6/2012 | Fitzpatrick, Jr. | |
| 2013/0220606 | A1* | 8/2013 | Yhuel | E21B 43/108 166/227 |
| 2018/0081468 | A1 | 3/2018 | Bruce et al. | |
| 2020/0011161 | A1 | 1/2020 | Bruce et al. | |

FOREIGN PATENT DOCUMENTS

WO 2005001244 A2 1/2005

OTHER PUBLICATIONS

International Search Report and Written Opinion of the International Searching Authority dated Mar. 12, 2026, in connection with International Application No. PCT/US2025/038222, 10 pages.

* cited by examiner

*Primary Examiner* — David Carroll

(57) ABSTRACT

An expandable downhole device may be used for supporting a wellbore and as a flow/sand control device. The expandable downhole device is initially RIH in a compressed state. Once the expandable downhole device reaches a predetermined depth in the wellbore, the expandable downhole device is transitioned from the compressed state to an expanded state to support the wellbore from collapsing. In the expanded state, an activation chamber of the expandable downhole device is expanded from a collapsed state to press an outer shroud of the expandable downhole device against the wellbore. A shape memory foam of the expandable downhole device is also expanded and hardens in the expanded state. The shape memory foam acts as a support layer for the activation chamber to provide additional support for the wellbore. The shape memory foam may be a porous material to be a filter media of the expandable downhole device.

20 Claims, 10 Drawing Sheets

SHAPE MEMORY FOAM SCREEN IN CONJUNCTION WITH SHROUDED OVER DEFORMABLE CHAMBERS FOR WELLBORE COMPLIANCE

BACKGROUND

This section is intended to provide relevant background information to facilitate a better understanding of the various aspects of the described embodiments. Accordingly, it should be understood that these statements are to be read in this light and not as admissions of prior art.

Hydrocarbons, such as oil and gas, are commonly obtained from subterranean formations that may be located onshore or offshore. To produce hydrocarbons, a wellbore is drilled through a hydrocarbon-bearing zone in a reservoir of the subterranean formations. Additionally, the wellbore may include one or more lateral wellbores extending from a main wellbore. A lateral wellbore is a wellbore that is diverted from the main wellbore. The main wellbore may include one or more windows or casing exits to allow corresponding lateral wellbores to be formed. The window or casing exits for multilateral wells are typically formed by positioning (e.g., anchoring) one or more whipstock assemblies in a casing string with a running tool at locations in the main wellbore. In some embodiments, whipstocks may be used to deflect a window mill relative to the casing string. The deflected window mill penetrates part of the casing joint to form the window or casing exit in the casing string and is then withdrawn from the wellbore. Generally tubular equipment can be subsequently inserted through the casing exit in order to cut the lateral wellbore, fracture the lateral wellbore, and/or service the lateral wellbore.

In hydrocarbon production operations, it may be useful to convey the generally tubular equipment into the wellbore (main and/or lateral wellbore) with a predetermined location in a radially-retracted state, and then to outwardly expand the equipment in the wellbore. This procedure may facilitate passing the equipment past an obstruction in the wellbore, and/or to support an unconsolidated wellbore wall at the predetermined location. Expandable wellbore support screens that have been employed provide support to the wellbore wall while filtering geologic fluids during production operations. In some instances, these wellbore screens may be expanded by passing an expansion tool therethrough, or by applying hydraulic pressure to the screens. In some instances, it may be desirable to limit the expansion of the screen so as to maintain the structural integrity of the screen. Using some methods for expanding the screens, however, it may be difficult to maintain a precise diameter of the screen without over expanding the screen while also supporting the wellbore and providing a filter medium for sand control.

BRIEF DESCRIPTION OF THE DRAWINGS

Aspects of the disclosure are described with reference to the following figures. The same or sequentially similar numbers are used throughout the figures to reference like features and components. The features depicted in the figures are not necessarily shown to scale. Certain features may be shown exaggerated in scale or in somewhat schematic form, and some details of elements may not be shown in the interest of clarity and conciseness.

DETAILED DESCRIPTION

The present disclosure describes an expandable downhole device for supporting a wellbore. The expandable downhole device may also be used as a flow and sand control device for a tubing string within the wellbore in both injection and production operations. The expandable downhole device is initially run-in-hole (RIH) in a compressed state. Once the expandable downhole device reaches a predetermined depth in the wellbore, the expandable downhole device is transitioned from the compressed state to an expanded state to support the wellbore from collapsing. This transition may be in response to a predetermined condition. In the expanded state, an activation chamber of the expandable downhole device is expanded from a collapsed state to press an outer shroud of the expandable downhole device against the wellbore. The activation chamber may be filled with hydraulic fluid to plastically deform and provide a pressing force against the wellbore thereby supporting the wellbore from collapsing. Additionally, a shape memory foam of the expandable downhole device is also expanded and hardens in the expanded state. The shape memory foam acts as a support layer for the activation chamber to provide additional support for the wellbore. Furthermore, the shape memory foam may be a porous material to be a filter media of the expandable downhole device. Acting as the filter media, the shape memory foam filters a fluid flowing through the expandable downhole device to prevent a passage of particulates larger than a predefined size either into an interior bore of the expandable downhole device prevent for production operations or into the wellbore for injection operations. It is further envisioned that the shape memory foam may be a non-porous material and therefore not act as a filter. In some embodiments, the expandable downhole device may include a filter media such as a weave or mesh adjacent to the activation chamber to provide a sand control by filtering the fluid flowing through the expandable downhole device. By using both the activation chambers and the shape memory foam, the expandable downhole device can be an anchor to support the wellbore while also providing more efficient and adaptable sand management in production and injection operations.

Figure 1:
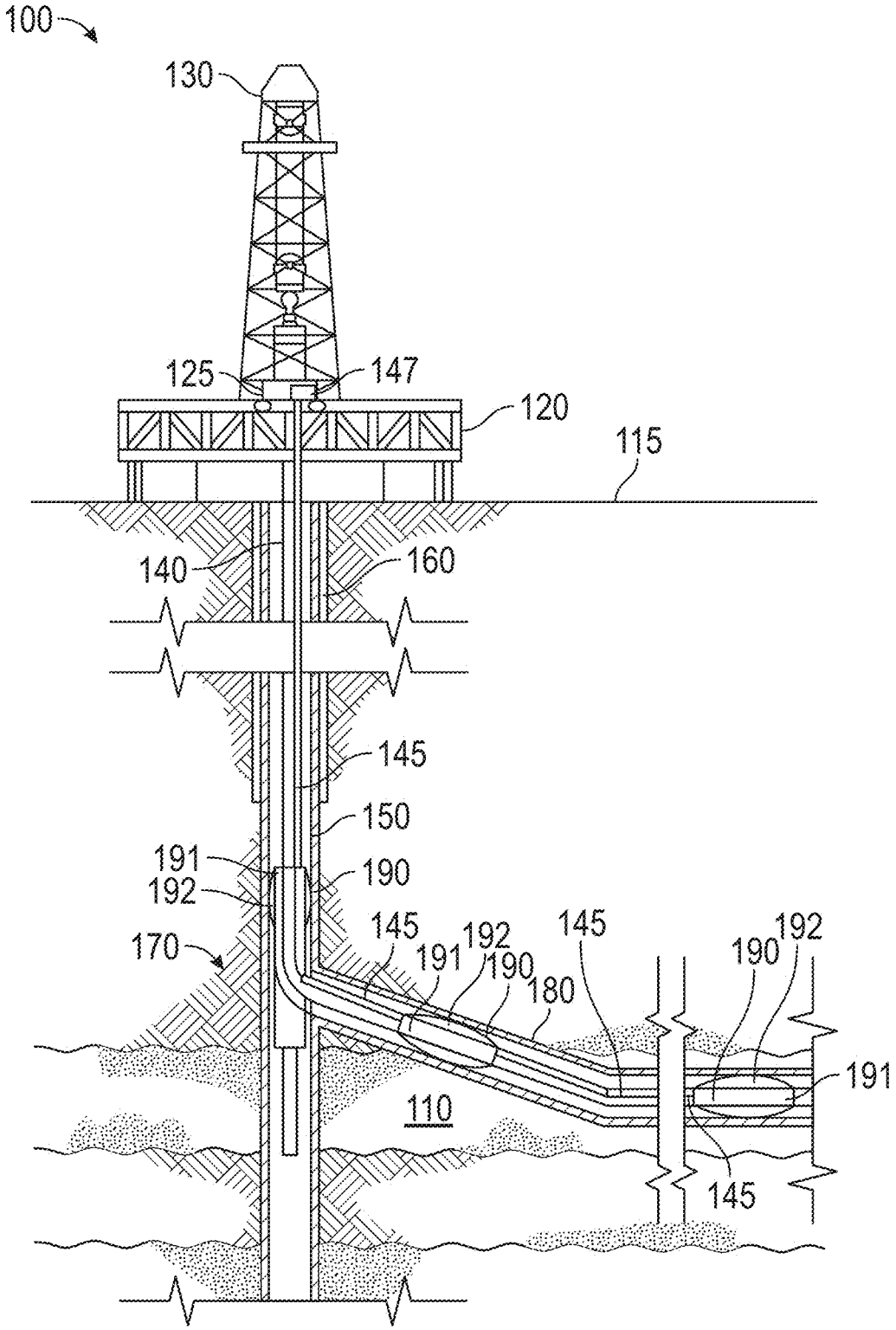
FIG. 1 illustrates a schematic view of a well system in accordance with one or more embodiments.

FIG. 1 is a schematic view of a well system 100 according to one or more embodiments disclosed herein. The well system 100 includes a platform 120 positioned over a subterranean formation 110 located below the earth's surface 115. The platform 120, in at least one embodiment, has a hoisting apparatus 125 and a derrick 130 for raising and lowering pipe strings, such as a tubing string 140 or a drilling string. Although the platform 120 is illustrated as a land-based oil and gas in FIG. 1, the scope of this disclosure is not thereby limited, and thus could potentially apply to offshore applications. The teachings of this disclosure may also be applied to other land-based well systems different from that illustrated.

As shown, a main wellbore 150 has been drilled through the various earth strata, including the subterranean formation 110. The term "main" wellbore is used herein to designate a wellbore from which another wellbore is drilled. It is to be noted, however, that a main wellbore 150 does not necessarily extend directly to the earth's surface, but could instead be a branch of yet another wellbore. A casing string 160 may be at least partially cemented within the main wellbore 150. The term "casing" is used herein to designate a tubular string used to line a wellbore. Casing may actually be of the type known to those skilled in the art as a "liner" and may be made of any material, such as steel or composite material and may be segmented or continuous, such as coiled tubing. The term "lateral" wellbore is used herein to designate a wellbore that is drilled outwardly from its intersection with another wellbore, such as a main wellbore. Moreover, a lateral wellbore may have another lateral wellbore drilled outwardly therefrom.

A whipstock 170 according to one or more embodiments of the present disclosure may be positioned at a location in the main wellbore 150. Specifically, the whipstock 170 could be placed at a location in the main wellbore 150 where it is specified for a lateral wellbore 180 to exit. Accordingly, the whipstock 170 may be used to support a milling tool used to penetrate a window in the main wellbore 150, and once the window has been milled and a lateral wellbore 180 formed, in some embodiments, the whipstock 170 may be retrieved and returned uphole by a retrieval tool, in some embodiments in only a single trip.

In some embodiments, one or more expandable downhole devices 190 may be connected in a tubing string 140 downhole to support the wellbore 180. The expandable downhole device 190 may also provide flow and sand control for fluids, such as drilling fluids, injection fluids, or produced fluids from the subterranean formation 110, being transported through the tubing string 140. Initially, the expandable downhole device 190 is deployed in a compressed state to reach various depths along the main wellbore 150 and/or the lateral wellbore 180. By RIH in the compressed state, the expandable downhole device 190 is able to travel past obstructions in the main wellbore 150 and/or the lateral wellbore 180, reach unconsolidated portions of the main wellbore 150 and/or the lateral wellbore 180, be positioned in irregular wellbore shapes of the main wellbore 150 and/or the lateral wellbore 180, and can be moved through various diameters of the main wellbore 150 and/or the lateral wellbore 180. Once the expandable downhole device 190 is positioned at a predetermined depth in the main wellbore 150 and/or the lateral wellbore 180, the expandable downhole device 190 is transitioned from the compressed state to an expanded state based on predetermined conditions (e.g., a predetermined pressure and temperature). In the expanded state, the expandable downhole device 190 can support the main wellbore 150 and/or the lateral wellbore 180*a* from collapsing. The expandable downhole device 190 may also prevent the main wellbore 150 and/or the lateral wellbore 180*a* from collapsing. The predetermined depth may be chosen based on various parameters such as, a depth at which the main wellbore 150 and/or the lateral wellbore 180 needs support or a depth at which needs both support and sand management.

The expandable downhole device 190 includes a base pipe 191 and one or more activation chambers (shown in the cross-sectional FIGS. below) positioned radially about the base pipe. The one or more activation chambers are provided beneath an outer shroud 192 of the expandable downhole device 190. The outer shroud 192 is disposed around and coupled to the base pipe 191 such that an annulus is formed is formed between the outer shroud 192 and the base pipe 191. The one or more activation chambers are positioned in this annulus. Additionally, the expandable downhole device 190 also includes a shape memory foam (shown in the cross-sectional FIGS. below) is in contact with the outer shroud 192 and/or the base pipe 191. For example, the shape memory foam may be disposed in the annulus formed between the outer shroud 192 and the base pipe 191.

The one or more activation chambers are configured to move from a compressed state (i.e., a first collapsed state) while RIH, to an expanded state or plastically deformed state (i.e., a second activated state) once the expandable downhole device 190 is positioned at the predetermined depth in the main wellbore 150 and/or the lateral wellbore 180. The one or more activation chambers may be hydraulically activated. For example, at the predetermined depth, fluid pressure may be applied within the one or more activation chambers to a predetermined internal pressure. A hydraulic line 145 may be deployed along side or within the tubing string 140 to fluidly connect the one or more activation chambers to a hydraulic fluid or pressure source. For example, a fluid tank or pressure vessel 147 at the surface may store the hydraulic fluid or pressure source and the hydraulic line 145 provides a flow path to transport the hydraulic fluid into the one or more activation chambers. A valve may be used to selectively open flow through the hydraulic line 145, once the expandable downhole device 190 reaches the predetermined depth. In some embodiments, the hydraulic fluid or pressure source may be provided downhole within the tubing string 140 or the expandable downhole device 190. At the predetermined internal pressure, the one or more activation chambers are expanded outwardly from the base pipe 191 to be plastically deformed into the expanded state. The one or more activation chambers push the outer shroud 192 radially outward to press the outer shroud 192 against a wall of the main wellbore 150 or the lateral wellbore 180. The outer shroud 192 may be used to grip the wall of the main wellbore 150 or the lateral wellbore 180. In the second activated state, the one or more activation chambers are engaged with the main wellbore 150 or the lateral wellbore 180 and exert a force radially outwardly to support the main wellbore 150 or the lateral wellbore 180 from collapsing.

The shape memory foam is also configured to move from a compressed state (i.e., a non-activate state) while RIH, to an expanded harden state (i.e., an activated state) once the expandable downhole device 190 is positioned at the predetermined depth in the main wellbore 150 and/or the lateral wellbore 180. The shape memory foam may undergo a chemical reaction based on a predetermined wellbore temperature. For example, at the predetermined depth, the shape memory foam will be exposed to a temperature in the main wellbore 150 and/or the lateral wellbore 180 such that the shape memory foam is heated to or greater than the predetermined wellbore temperature. The predetermined wellbore temperature is a glass transition temperature of the shape memory foam. At the glass transition temperature, the shape memory foam will expand and harden. As expansion occurs, the shape memory foam may expand into a void space between the outer shroud 192, the one or more activation chambers, and the base pipe 191. Alternative to filling the void space, the shape memory foam may just fill a specified area within the annulus. For example, the specified area may be an area adjacent to the one or more activation chambers, an area between the one or more activation chambers and the base pipe 191, an area between the one or more activation chambers and the outer shroud 192, or a combination thereof. Once hardened, the shape memory foam will act as a support layer for the one or more activation chambers to provide additional support to the main wellbore 150 and/or the lateral wellbore 180. Addition, in the expanded harden state, the shape memory foam can also prevent the one or more activation chambers from undergo a rocking phenomenon. The rocking phenomenon occurs when the one or more activation chambers are moving radially or axially back and forth along the base pipe 191. This rocking phenomenon can cause the one or more activation chambers to lose their engagement and no longer support the main wellbore 150 and/or the lateral wellbore 180. By using the shape memory foam as a support layer, the one or more activation chambers are additionally secured against the rocking phenomenon occurring.

In some embodiments, the expandable downhole devices 190 may include a filter media to filter the fluids flowing through the expandable downhole devices 190. For example, the filter media will filter the fluid by preventing a passage of particulates larger than a predefined size from flowing through the filter media. The shape memory foam may be made from a porous material such that when the shape memory foam is in the expanded harden state, the shape memory foam is the filter media of the expandable downhole devices 190. This allows the shape memory foam to act both as support for the one or more activation chambers and as a sand filter for downhole fluid production. Alternative to the shape memory foam being the filter media, the filter media may be a weave or mesh provided in the annulus between the outer shroud 192 and the base pipe 191.

In one or more embodiments, one of the expandable downhole devices 190 may be used to support and anchor downhole tools, such as the whipstock 170, for maintaining the whipstock 170 in place while drilling the lateral wellbore 180. The expandable downhole device 190, acting as an anchor, may be employed in a cased region of the wellbore 180 or alternatively in an open-hole region of the wellbore 180. As such, the expandable downhole device 190 may be configured to resist at least 6,750 newton meters (Nm) (e.g., about 5,000 lb-ft) of torque. In yet another embodiment, the expandable downhole device 190 may be configured to resist at least 13,500 newton meters (Nm) (e.g., about 10,000 lb-ft) of torque, and in yet another embodiment configured to resist at least 20,250 newton meters (Nm) (e.g., about 15,000 lb-ft) of torque. Similarly, the expandable downhole device 190 may be configured to resist at least 1814 kg (e.g., about 4,000 lb) of axial force. In yet another embodiment, the expandable downhole device 190 may be configured to resist at least 4536 kg (e.g., about 10,000 lb) of axial force, and in yet another embodiment the expandable downhole device 190 may be configured to resist at least 6804 kg (e.g., about 15,000 lb) of axial force.

Figure 2:
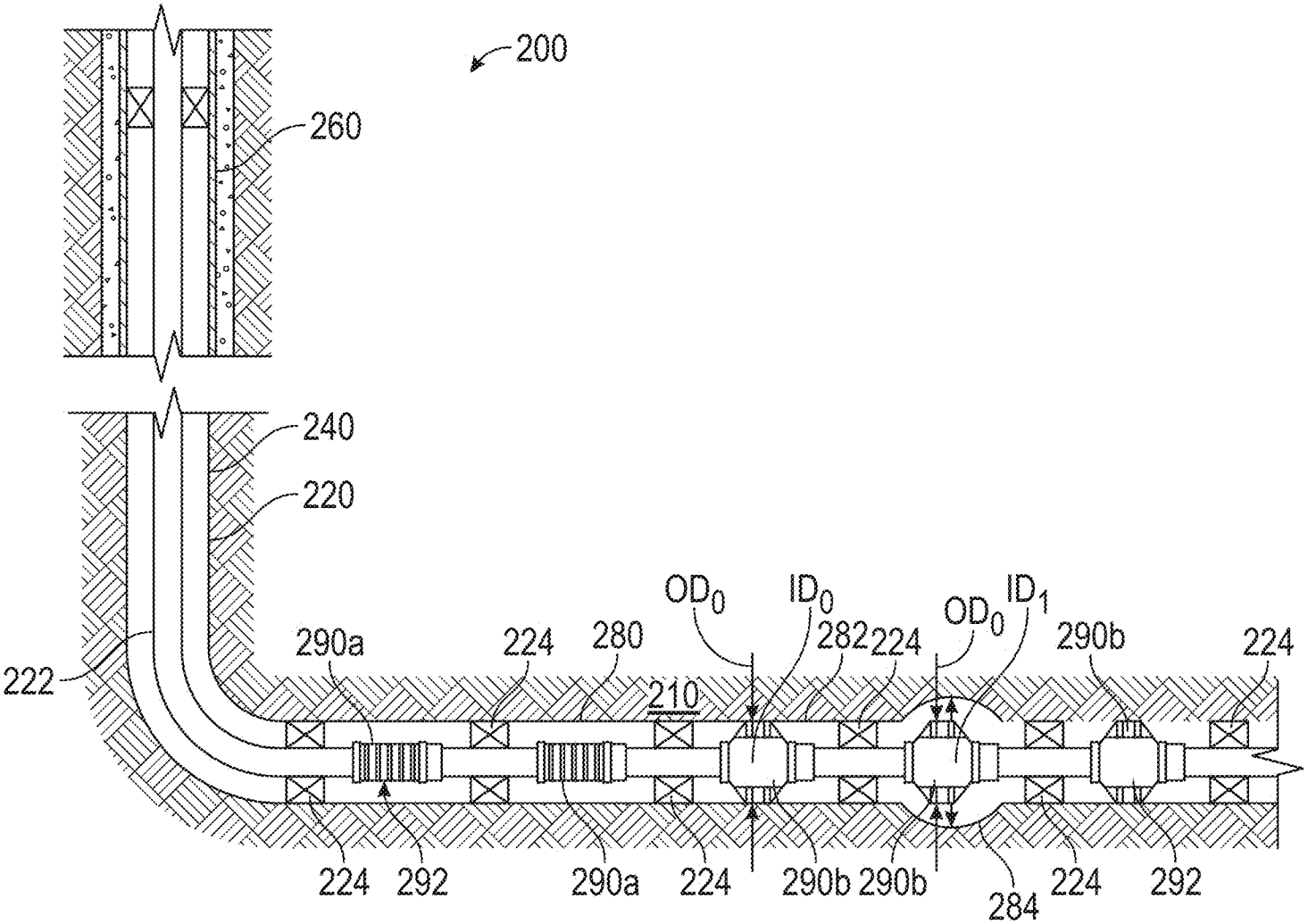
FIG. 2 illustrates a schematic view of a wellbore system in accordance with one or more embodiments

Referring now to FIG. 2, a wellbore system 200 includes a plurality of expandable downhole devices 290*a*, 290*b* therein. Each of the expandable downhole devices 290*a*, 290*b* is equipped with an outer shroud 292 arranged to contain one or more components and for limiting an expansion of the expandable downhole devices 290*a*, 290*b* according to one or more embodiments of the present disclosure. In the wellbore system 200, a wellbore 220 extends through a formation 210 (e.g., a geological or subterrain formation). The wellbore 220 has a substantially vertical section 240, the upper portion of which has a casing string 260 cemented therein. A substantially horizontal section 280 of the wellbore 220 extends through a hydrocarbon bearing portion of the formation 210. As illustrated, the horizontal section 280 of wellbore 220 is open hole. In other embodiments, the wellbore 220 may be fully cased or extend along alternate trajectories including deviated or slanted portions, multilateral portions and other wellbore features without departing from the principles of the disclosure.

Positioned within wellbore 220 and extending from a surface location (not shown) is a tubing string 222. The tubing string 222 provides a conduit for hydrocarbons or other formation fluids to travel from formation 210 to the surface location and for injection fluids to travel from the surface to formation 210. At its lower end, the tubing string 22 defines a completion string that divides the horizontal section 18 into various production intervals adjacent to formation 20. The tubing string 222 includes the plurality of expandable downhole devices 290*a*, 290*b* coupled therein, each of which is positioned between a pair of annular barriers such as packers 224. The packers 224 provide a fluid seal between the tubing string 222 and formation 210, thereby defining the production intervals. Any number of expandable downhole devices 290*a*, 290*b* may be deployed within a single production interval between packers 224, and/or within a completion interval that does not include production intervals without departing from the principles of the present disclosure.

In one or more embodiments, the expandable downhole devices 290*a*, 290*b* may operate to support the horizontal section 280 of wellbore 220 and filter particulate matter out of fluids collected from the formation 210 and may include flow restrictors therein to regulate the flow therethrough during production operations. Alternatively, or additionally, the expandable downhole devices 290*a*, 290*b* may be operable to control the flow of an injection fluid stream from the tubing string 222 into the formation 210 while supporting the horizontal section 280 of wellbore 220. The expandable downhole devices 290*a* are illustrated in a compressed state (or radially retracted configuration), which facilitates running the expandable downhole devices 290*a* into the wellbore 220 to reach various depths without being obstructed. The expandable downhole devices 290*a* may be selectively expanded to assume an expanded state (or radially expanded configuration) of the expandable downhole devices 290*b*. Generally, the expandable downhole devices 290*b* in the expanded state exhibit an outer diameter ODO generally consistent with a nominal inner diameter ID0 of the wellbore 12. Thus, the expandable downhole devices 290*b* contact a wall 282 of the wellbore 220 in the horizontal section 280. In some instances, at least a portion 284 of the wellbore 220 may exhibit an enlarged inner diameter ID, e.g., where washouts exist in the wellbore 220. The outer shroud 292 of the expandable downhole devices 290*b* may limit the degree to which the expandable downhole devices 290*b* are expanded in the wellbore 220 such the expandable downhole devices 290*b* in the portion 284 of the wellbore 220 having an expanded inner diameter ID1 may maintain an outer diameter ODO that is safe for the structural integrity of the expandable downhole devices 290*b*.

Figure 3A:
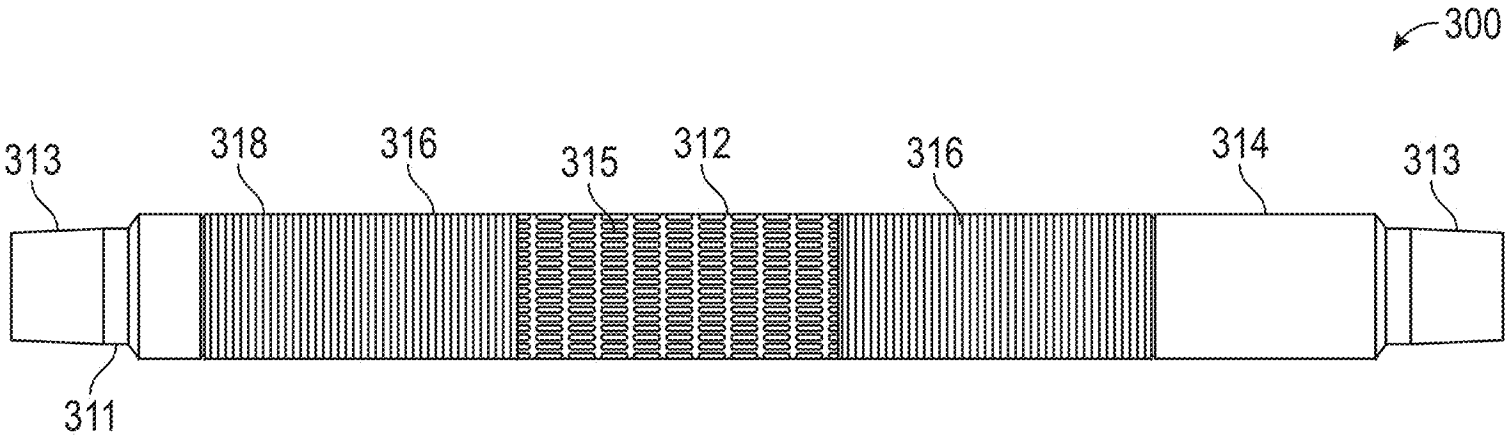
FIG. 3A shows a side view of an expandable downhole device in a compressed state in accordance with one or more embodiments.
Figure 3B:
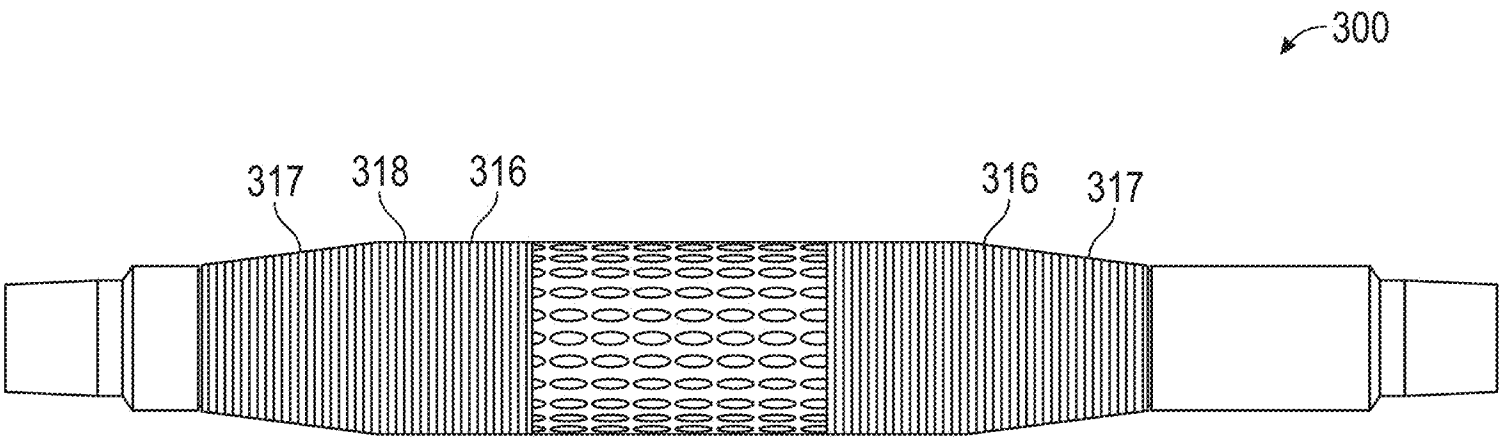
FIG. 3B shows a side view of an expandable downhole device in an expanded state in accordance with one or more embodiments.

Now referring to FIGS. 3A and 3B, a side view of the expandable downhole device 300 is illustrated in accordance with one or more embodiments. FIG. 3A shows the expandable downhole device 300 in a compressed state (corresponding to an un-activated or retracted configuration illustrated in FIG. 2), whereas FIG. 3B shows the expandable downhole device 300 in an expanded state (corresponding to an activated or extended configuration in FIG. 2).

The expandable downhole device 300 is provided with threaded pin and box-type connections 313 at each end. One end of the expandable downhole device 300 also includes the valve arrangement 314 for controlling the inflation of the activating elements provided in the expandable downhole device 300, and also for controlling the flow of fluid from the surrounding formation, through an outer shroud 312 and into a base pipe 311. The outer shroud 312 includes perforations 315 to allow fluid communication through the outer shroud 312.

In one or more embodiments, the expandable downhole device 300 is also capable of providing zonal isolation. In particular, the ends of the portion of the expandable downhole device 300 that are capable of extension on activation of the expandable downhole device 300 are coated with an elastomer sleeve 316. On activation of expandable downhole device 300, the elastomer sleeve 316 is pushed out into contact with the bore wall and serves to isolate the zone on one side of the elastomer sleeve 316 from the zone on the other side of the elastomer sleeve 316. Thus, once activated, the activated elastomer sleeve 316 prevents production fluid from flowing axially between the bore wall and the expandable downhole device 300, and indeed axially through the portion of the expandable downhole device 300 between the base pipe 311 and the bore wall. This serves to protect the components beneath the outer shroud at a transition area 317, preventing axial flow through the transition area 317, which it has been found is the area where a filter media tends to be weakest, and where the filter media might otherwise be vulnerable to erosion damage. Additionally, the elastomer sleeve 316 may define circumferentially extending ridges or ribs 318 to improve a sealing effect against the wellbore. Flow into the expandable downhole device 300 from the surrounding formation may thus only take place through the fully extended portion of the outer shroud 312, between the elastomer sleeves 316, where the outer shroud 312 typically contacts and supports the bore wall. Flow through the outer shroud 312 will thus tend to be radial. Additionally, as shown in FIG. 3A, the outer shroud 312 may be made from a metal sheet with the perforations 315 which are a multitude of initially closed openings in the form of staggered or overlapping axial slots. On activation of the expandable downhole device 300, the outer shroud 312 and thus the metal sheet is circumferentially extended, such that the perforations 315 open to the form illustrated in FIG. 3B.

Figure 4A:
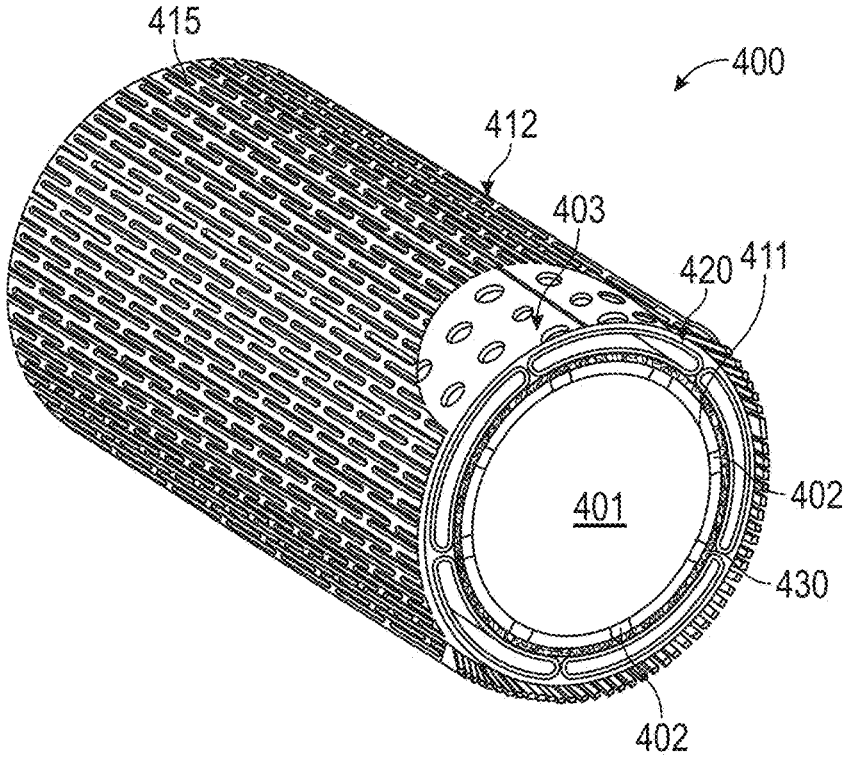
FIG. 4A shows a perspective view of an expandable downhole device in a compressed state in accordance with one or more embodiments.
Figure 4B:
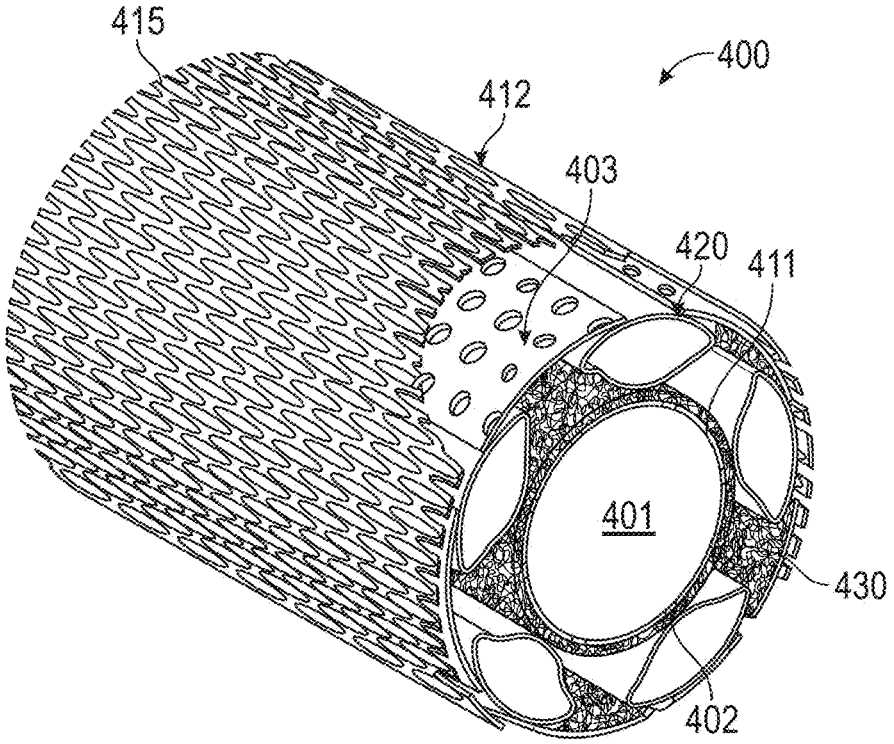
FIG. 4B shows a perspective view of the expandable downhole device of FIG. 4A in an expanded state in accordance with one or more embodiments.

Turning to FIGS. 4A and 4B, perspective cutaway views of an expandable downhole device 400 are illustrated in accordance with one or more embodiments. To better illustrate the internal components beneath an outer shroud 412 of the expandable downhole device 400, the ends of the expandable downhole device 490 are not shown. FIG. 4A shows the expandable downhole device 400 in a compressed state, whereas FIG. 4B shows the expandable downhole device 400 in an expanded state.

The expandable downhole device 400 includes a base pipe 411 defining an interior bore 401. Additionally, the base pipe 411 may also include fluid passageways 402 to provide fluid communication between an exterior of the base pipe 411 and the interior bore 401. The outer shroud 412 is disposed about the base pipe 411 to form a space or annulus between the outer shroud 412 and the base pipe 411. The outer shroud 412 also includes perforations 415 to allow fluid flow through the outer shroud 412.

In the annulus between the outer shroud 412 and the base pipe 411, one or more activation chambers 420 and a shape memory foam 430 are disposed therein. The one or more activation chambers 420 may be positioned radially about the base pipe 411. In at least one embodiment, the one or more activation chambers 420 may be one full donut shaped expandable chamber that is positioned about the base pipe 411. In at least one other embodiment, two or more activation chambers 420 may be positioned radially about the base pipe 411. In at least one another embodiment, six activation chambers 420 may be positioned radially and spaced evenly around a circumference of the base pipe 411. The activation chambers 420 may be configured to move from the compressed state (e.g., the first collapsed state shown in FIG. 2A) to the expanded state (e.g., the second activated state shown in FIG. 2B) to engage a wall of a wellbore. For example, the activation chambers 420 may be filled with hydraulic fluids to increase an internal pressure thereby expanding the activation chambers 420. In some embodiments, when in the second activated state, the activation chambers 420 may be operable to handle at least 20.7 Bar (about 300 psi) of internal pressure in the second activated state to engage the wall of a wellbore. In some embodiments, when in the second activated state, the activation chambers 420 may be operable to handle at least 27.6 Bar (about 400 psi) of internal pressure in the second activated state to engage the wall of a wellbore. In some embodiments, when in the second activated state, the activation chambers 420 may be operable to handle at least 51.7 Bar (about 750 psi) of internal pressure in the second activated state to engage the wall of a wellbore. In some alternative embodiments, when in the second activated state, the activation chambers 420 may be operable to handle at least 68 Bar (about 1000 psi) of internal pressure in the second activated state to engage the wall of a wellbore.

In one or more embodiments, the outer shroud 412 may be configured to split apart or deform as the activation chambers 420 expand into the second activated state such that the activation chambers 420 may thereafter engage and dig into the wall of the wellbore. For example, the activation chambers 420 apply a radial force to the outer shroud 412 to urge the outer shroud 412 to expand radially outward with respect to the base pipe 411. As the activation chambers 420 continue to expand, the radial displacement of the outer shroud 412 may increase in a non-linear manner. Additionally, the perforations 415 allow for the outer shroud 412 to easily expand. For example, to permit radial displacement as the outer shroud 412 expands, the perforations 415 are elongated and deformed into generally diamond shaped apertures. The general size and shape of the perforations 415 may vary greatly and remain within the scope of the disclosure. In at least one embodiment, the perforations 415 are larger than the opening in a typical sand screen. For example, the perforations 415 would have a mesh value of at least about 36 (e.g., 485 μm) or greater. In yet another embodiment, the perforations 415 would have a mesh value of at least about 20 (e.g., 850 μm) or greater, or in yet another embodiment the perforations 415 would have a mesh value of at least about 10 (e.g., 2,000 μm) or greater.

The shape memory foam 430 may be made from compositions of polyurethane foam that are able to be formulated to achieve specified glass transition temperatures which are suitable for wellbore environments. In one or more embodiments, the shape memory foam 430 may be a polyurethane foam. The polyurethane foam is extremely tough and strong and is capable of being compressed and returned to substantially its original non-compressed shape. The polyurethane foam material is made in one non-limiting embodiment from one or more polyol, such as, but not limited to, a polyether, polyester or polycarbonate-based di- or multifunctional hydroxylended prepolymer or polyol, and at least one isocyanate, including, but not limited to, a modified isocyanate (MI) or a modified diphenylmethane diisocyanate (MDI) based monomeric diisocyanate or polyisocyanate. Additionally, the shape memory foam 430 may include other additives including, but not limited to, blowing agents, molecular cross linkers, chain extenders, surfactants, colorants and catalysts.

The shape memory foam 430 is initially in a compressed state around the base pipe 411, as shown in FIG. 4A. The shape memory foam 430 is brought to the compressed state during manufacturing or assembly of the expandable downhole device 400. For example, the shape memory foam 430 may be mechanically compressed a percentage from an original volume (i.e., the expand state filling the annulus formed between the base pipe 411 and the outer shroud 412) to be position about the base pipe 411. To mechanically compress the shape memory foam 430, the shape memory foam 430 is heated to a temperatures above a glass transition temperature for the compositions of polyurethane foam at which the shape memory foam 430 becomes soft. While soft, the shape memory foam 430 is compressed and shaped to fit between the base pipe 411 and the activation chambers 420. It is further envisioned that the shape memory foam 430 may be boned or glued to the base pipe 411 or the activation chambers 420. Once compressed and shaped, the shape memory foam 430 may then be cooled below the glass transition temperature where the shape memory foam 430 remains in the compressed state after manufacture or assembly, at surface temperatures or at specified wellbore temperatures (e.g., below the glass transition temperature) during RIH.

Once the activation chambers 420 expand into the second activated state, the shape memory foam 430 is exposed to a predetermined wellbore temperature. This allows the shape memory foam 430 to expand and harden within the annulus formed between the base pipe 411 and the outer shroud 412. The shape memory foam 430 is expanded and hardened by chemically reacting to the predetermined wellbore temperature for a given amount of time (i.e., exposure time). For example, the predetermined wellbore temperature may be a temperature ranging between 60° Celsius to 170° Celsius. Additionally, the given amount of time may be approximately 20 minutes. The chemical reaction may be further aided by fluid properties of a fluid flowing through the now expanded outer shroud 412. For example, the fluid may change a pH level in the shape memory foam 430 or the fluid may have solvents and reactants to react with the shape memory foam 430. The shape memory foam 430 possess hibernated shape memory that provides a shape (e.g., the original un-compressed state) to the annulus formed between the base pipe 411 and the outer shroud 412 when exposed to the predetermined wellbore temperature. The predetermined wellbore temperature correlates to a glass transition temperature required to heat the shape memory foam 430 into expanding and become a rigid hard material to support the activation chambers 420.

In one or more embodiments, in the harden expanded state, the shape memory foam 430 may be porous to act as a filter media for the expandable downhole device 400. As the filter media, the shape memory foam 430 can prevent or restrict sand inflow into the base pipe 411. For example, the shape memory foam 430 prevents a passage of particulates (e.g., unwanted solids) larger than a predefined size into the base pipe 411. The predefined size may be based on a specified fluid composition for producing fluids or injecting fluids.

In some embodiments, the expandable downhole device 400 may optionally include bridging plates 403. For example, two or more bridging plates 403 may be positioned radially about the activation chambers 420. The two or more bridging plates 403 may be configured to extend across at least a gap between outer portions of the activation chambers 420 when the activation chambers 420 are in the second activated state as shown in FIG. 4B. The two or more bridging plates 403 may be configured to provide support for the outer shroud 412 positioned about the activation chambers 420. While it is illustrated that the two or more bridging plates 403 include openings therein, other embodiments may exist wherein the two or more bridging plates 403 do not include openings therein. The openings of the bridging plates 403 may act as a secondary filter and distribute flow more evenly through the shape memory foam 430 (i.e., the primary mesh filter layer). Although not shown in the illustrated embodiment, certain embodiments of the two or more bridging plates 403 may include protrusions or a textured surface which may engage the wall of the wellbore, and in some embodiments, the protrusions may extend through the perforations 415 in the outer shroud 412.

Figure 5A:
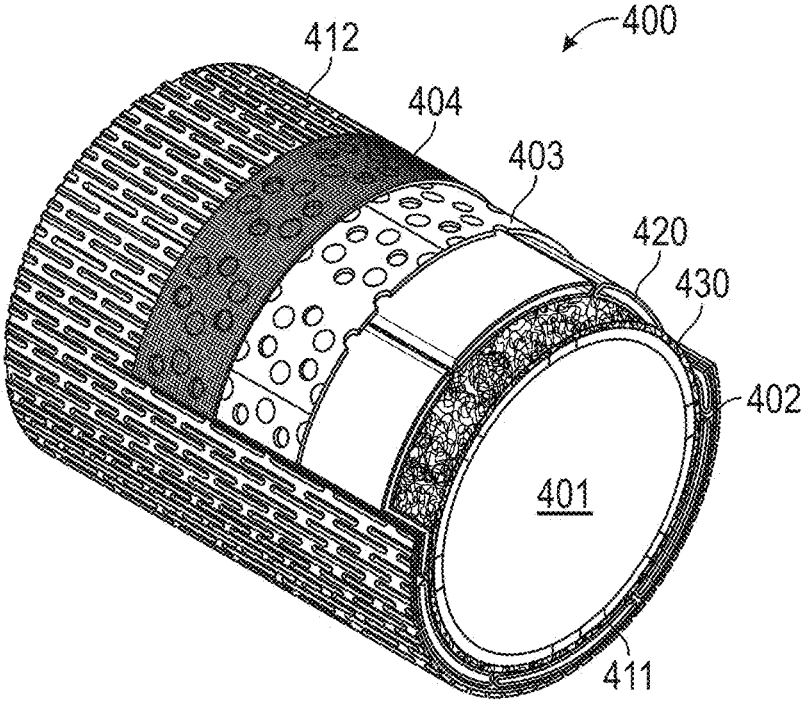
FIG. 5A shows a perspective view of an expandable downhole device in a compressed state in accordance with one or more embodiments.
Figure 5B:
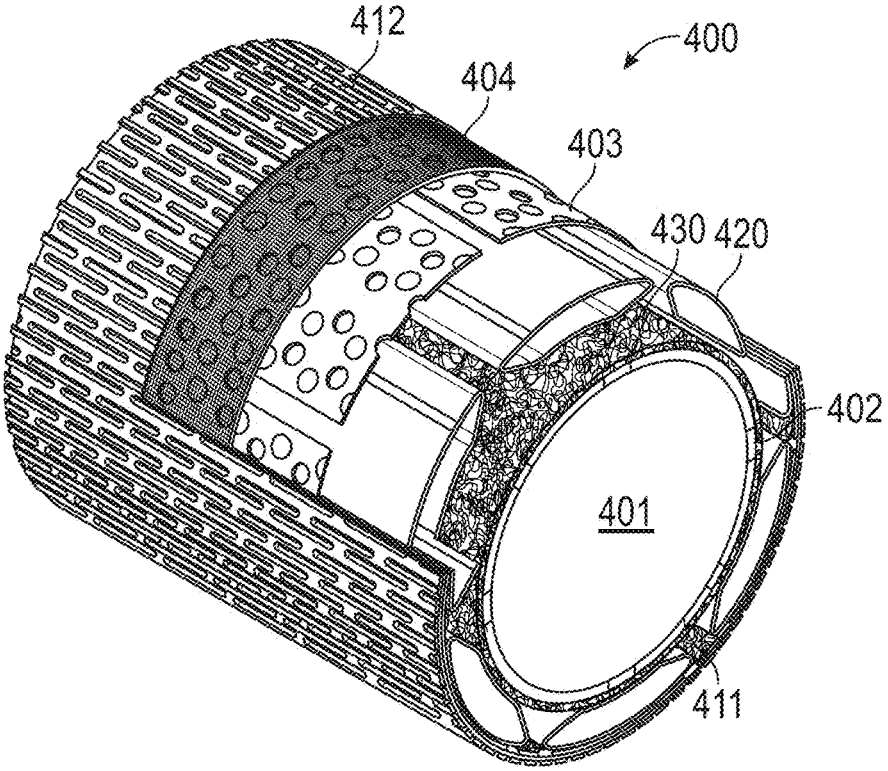
FIG. 5B shows a perspective view of the expandable downhole device of FIG. 5A in an expanded state in accordance with one or more embodiments.

Turning to FIGS. 5A and 5B, perspective cutaway views of the expandable downhole device 400 are illustrated in accordance with one or more embodiments, where like numerals represent like parts. The expandable downhole device 400 of FIGS. 5A and 5B is similar to that of the expandable downhole device 400 of FIGS. 4A and 4B. However, the expandable downhole device 400 of FIGS. 5A and 5B includes a second filter media 404. The second filter media 404 may be a mesh or weave made from a metal material. The second filter media 404 may be positioned beneath the outer shroud 412 and above the activation chambers 420. It is further envisioned that the second filter media 404 anywhere within the space between the outer shroud 412 and the base pipe 411 or even on top of the outer shroud 412. The second filter media 404 can provide an additional layer of filtration along with the shape memory foam 430. The second filter media 404 may also distribute flow more evenly through the shape memory foam 430. The second filter media 404 may be configured to prevent a passage of particulates (e.g., unwanted solids) larger than a second predefined size into the base pipe 411. The second predefined size may be the same, or bigger, or smaller size as the predefined size of the shape memory foam 430. The shape memory foam 430 provides stability and support to the activation chambers 420. Additionally, the bridging plates 403 gaps after the activation chambers 420 have expanded to provide support for the second filter media 404 and the outer shroud 412 above the bridging plates 403.

Figure 6A:
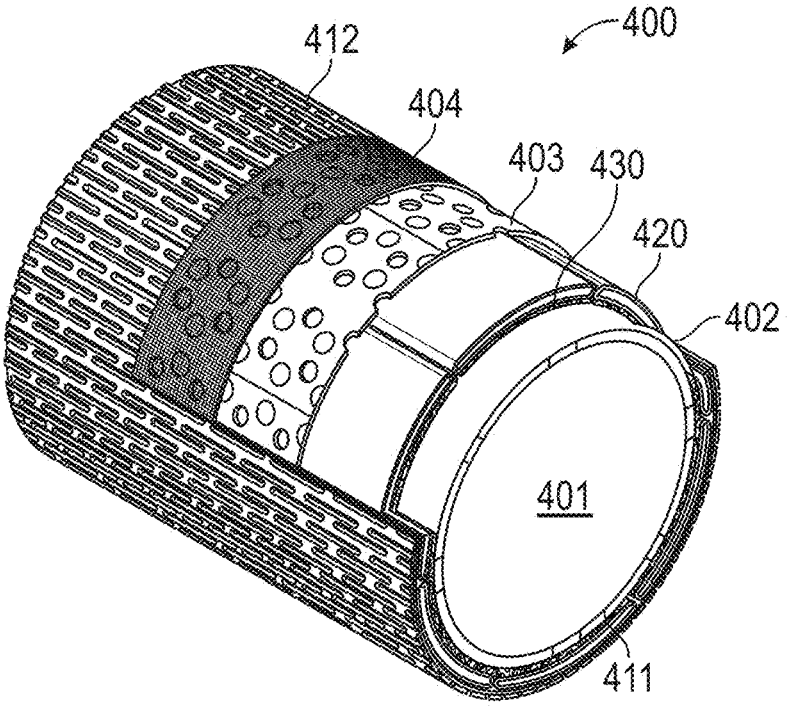
FIG. 6A shows a perspective view of an expandable downhole device in a compressed state in accordance with one or more embodiments.
Figure 6B:
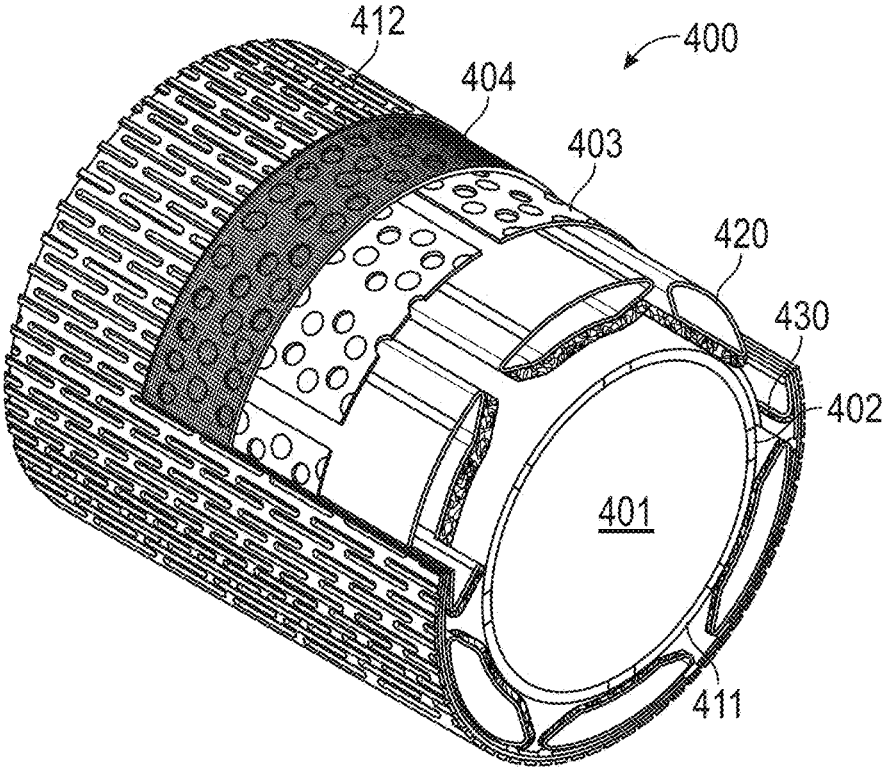
FIG. 6B shows a perspective view of the expandable downhole device of FIG. 6A in an expanded state in accordance with one or more embodiments.

Turning to FIGS. 6A and 6B, perspective cutaway views of the expandable downhole device 400 are illustrated in accordance with one or more embodiments, where like numerals represent like parts. The expandable downhole device 400 of FIGS. 6A and 6B is similar to that of the expandable downhole device 400 of FIGS. 5A and 5B. However, instead of being a filter media, the shape memory foam 430 of FIGS. 6A and 6B is not made of a porous material such that the shape memory foam 430 does not act as a filter. The second filter media 404 acts as a primary filter media for the expandable downhole device 400 with the shape memory foam 430 being non-porous. Additionally, the shape memory foam 430 may be positioned between the activation chambers 420 and the base pipe 411 such that a drainage area or flow area is formed in a space between the activation chambers 420. The shape memory foam 430 provides stability and support to the activation chambers 420 during and after expansion.

Figure 7A:
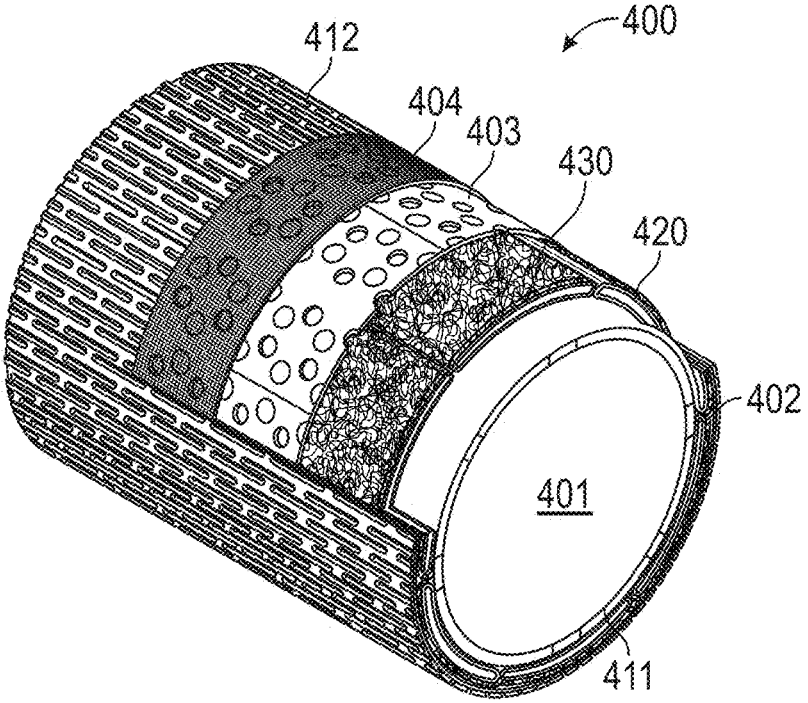
FIG. 7A shows a perspective view of an expandable downhole device in a compressed state in accordance with one or more embodiments.
Figure 7B:
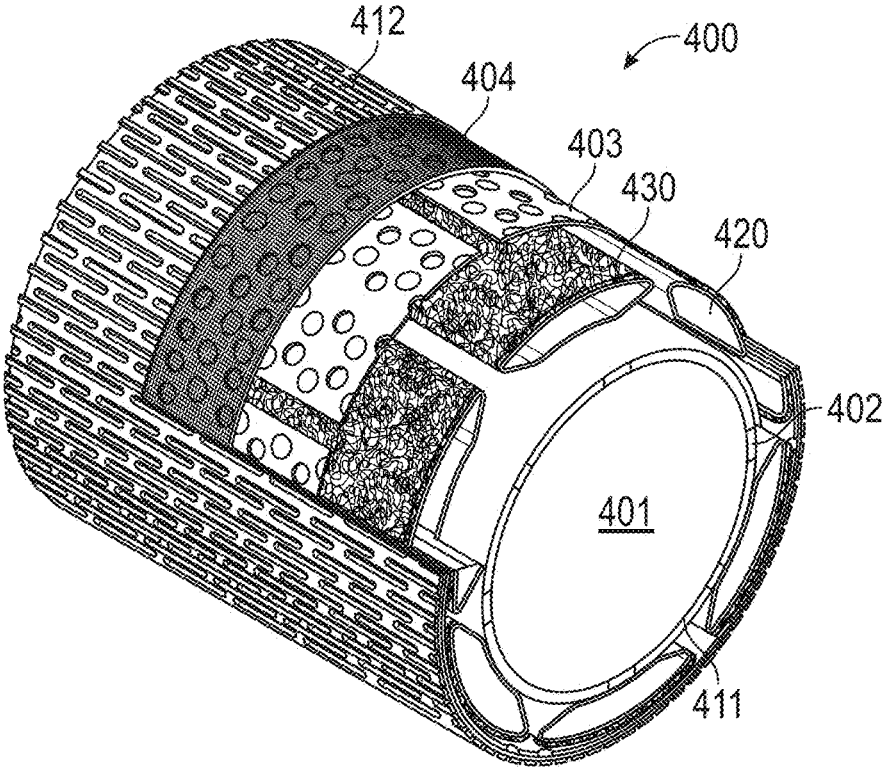
FIG. 7B shows a perspective view of the expandable downhole device of FIG. 7A in an expanded state in accordance with one or more embodiments.

Turning to FIGS. 7A and 7B, perspective cutaway views of the expandable downhole device 400 are illustrated in accordance with one or more embodiments, where like numerals represent like parts. The expandable downhole device 400 of FIGS. 7A and 7B is similar to that of the expandable downhole device 400 of FIGS. 6A and 6B. However, instead of the shape memory foam 430 being between the activation chambers 420 and the base pipe 411, the shape memory foam 430 is on top of each activation chambers 420. For example, the shape memory foam 430 may be positioned between the activation chambers 420 and the outer shroud 412. By positioning the shape memory foam 430 on top of the activation chambers 420, a drainage area or flow area is formed between adjacent the activation chambers 420.

Figure 8A:
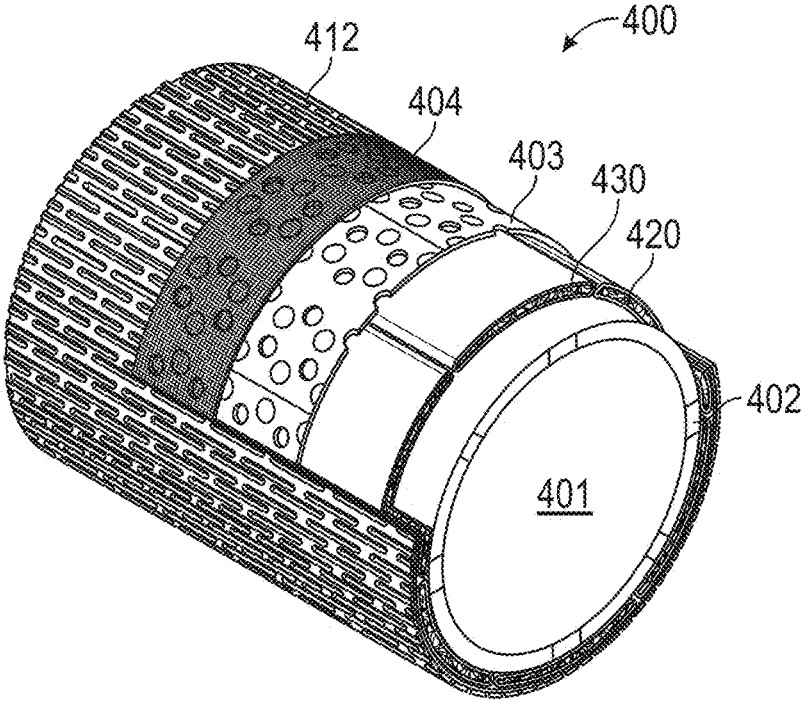
FIG. 8A shows a perspective view of an expandable downhole device in a compressed state in accordance with one or more embodiments.
Figure 8B:
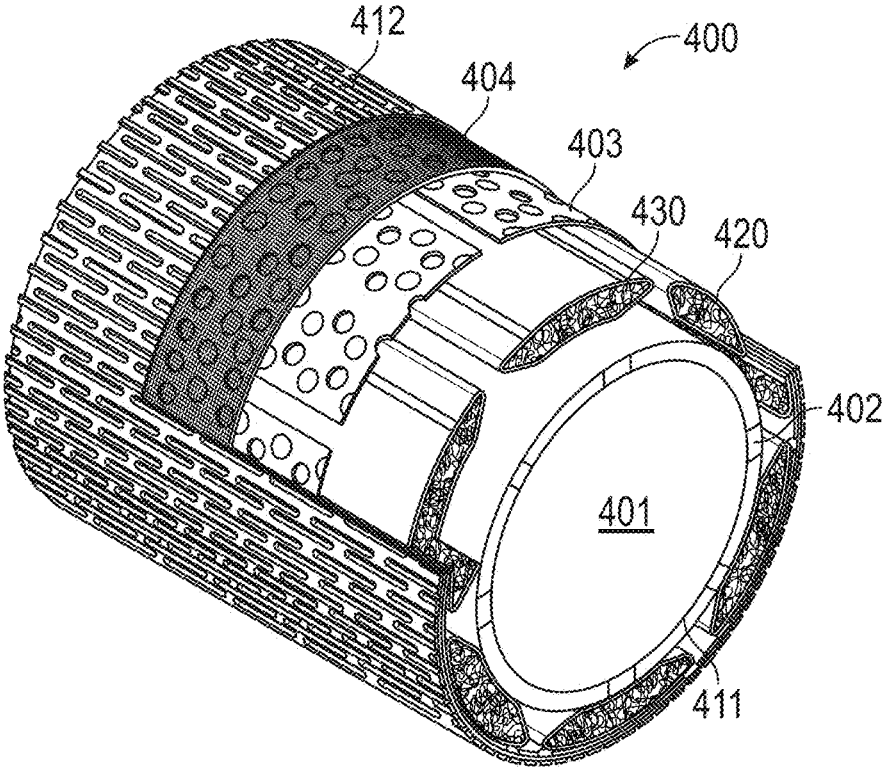
FIG. 8B shows a perspective view of the expandable downhole device of FIG. 8A in an expanded state in accordance with one or more embodiments.

Turning to FIGS. 8A and 8B, perspective cutaway views of the expandable downhole device 400 are illustrated in accordance with one or more embodiments, where like numerals represent like parts. The expandable downhole device 400 of FIGS. 8A and 8B is similar to that of the expandable downhole device 400 of FIGS. 6A and 6B. However, instead of the shape memory foam 430 being between the activation chambers 420 and the base pipe 411, the shape memory foam 430 is positioned within each activation chambers 420. The shape memory foam 430 provides reinforcement to the inside of the activation chambers 420. In an event that the activation chambers 420 lose an activation pressure, the shape memory foam 430 therein helps support the activation chambers 420. Additionally, when the expanded state, the shape memory foam 430 may also help prevent the activation chambers 420 from being collapsed to maintain keeping the activation chambers 420 in the expanded state.

Figure 9A:
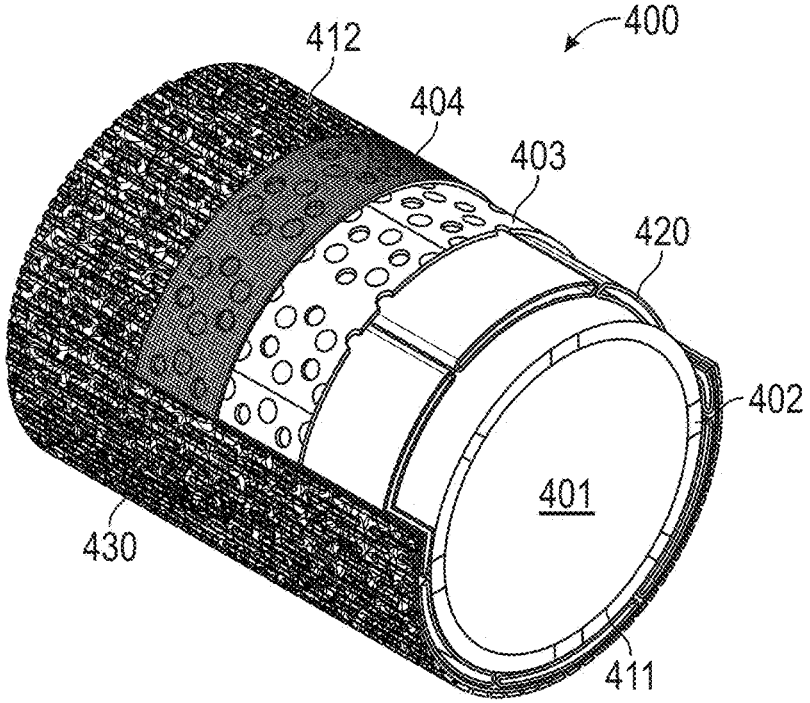
FIG. 9A shows a perspective view of an expandable downhole device in a compressed state in accordance with one or more embodiments.
Figure 9B:
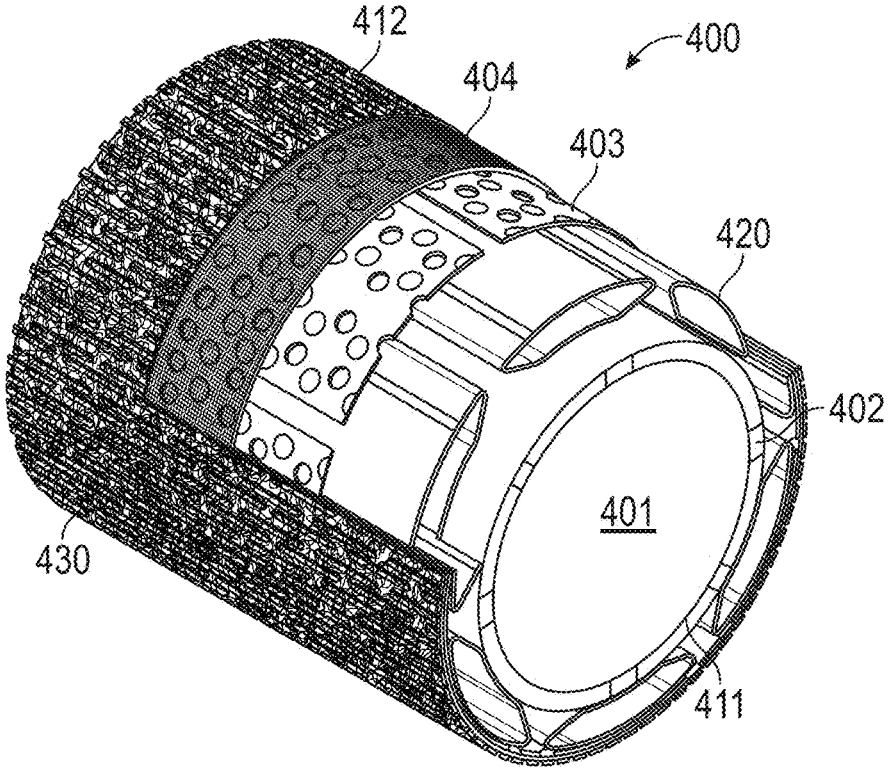
FIG. 9B shows a perspective view of the expandable downhole device of FIG. 9A in an expanded state in accordance with one or more embodiments.

Turning to FIGS. 9A and 9B, perspective cutaway views of the expandable downhole device 400 are illustrated in accordance with one or more embodiments, where like numerals represent like parts. The expandable downhole device 400 of FIGS. 9A and 9B is similar to that of the expandable downhole device 400 of FIGS. 5A and 5B. However, instead of being the shape memory foam 430 between the outer shroud 412 and the base pipe 411, the shape memory foam 430 is provided on top of the outer shroud 412. This provides increased conformance to a shape of the wellbore, which can help control wellbore solids and provide increased wellbore support.

Figure 10:
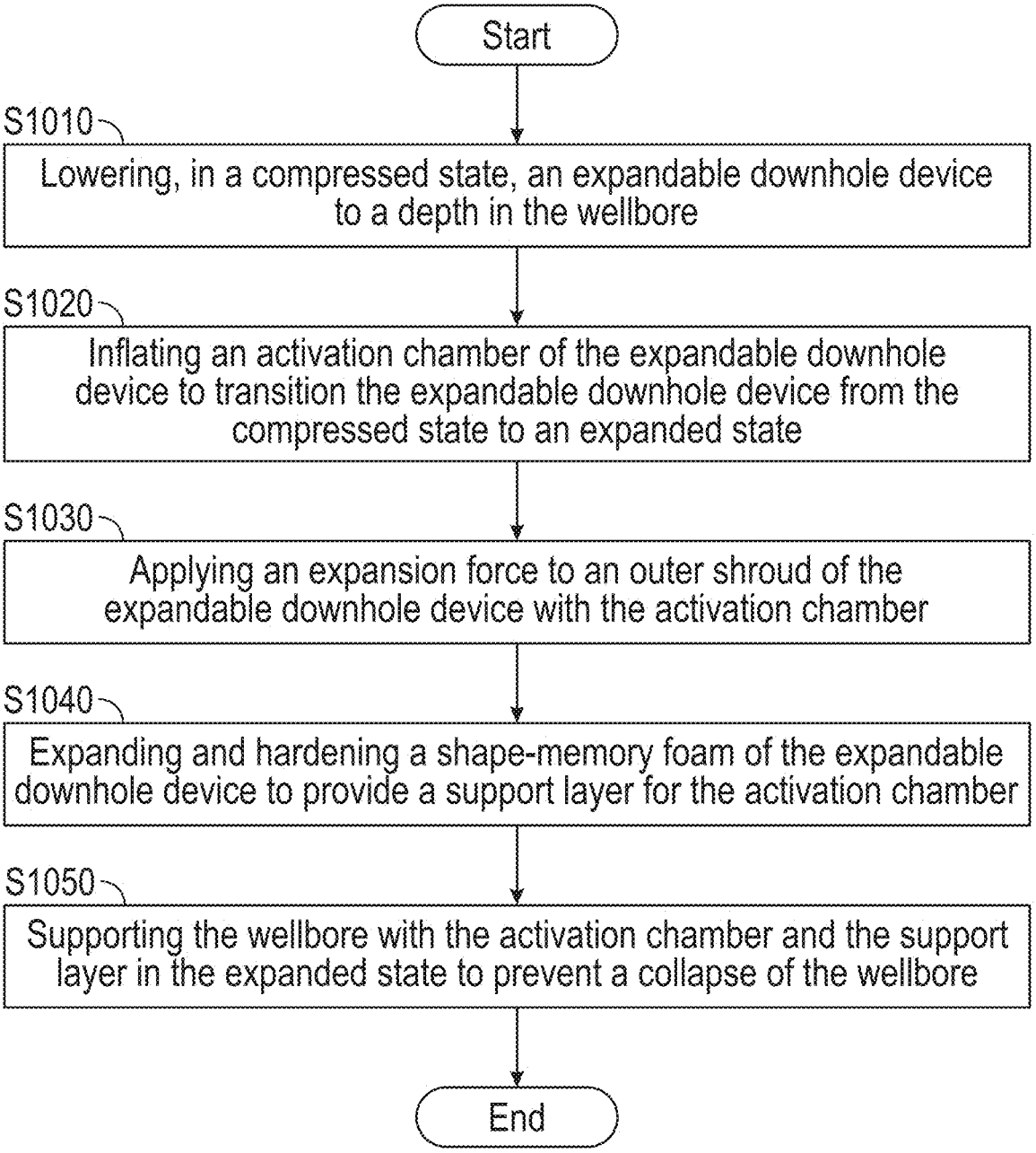
FIG. 10 a flow chart of an example method for operating an expandable downhole device in accordance with one or more embodiments.

FIG. 10 is a flow chart of an example method for deploying and operating the expandable downhole device described above in FIGS. 1-9B. One or more steps in FIG. 10 may be performed by one or more components (e.g., a computing system coupled to a controller in communication with the expandable downhole device and various equipment at a well) as described in FIGS. 1-9B. For example, a non-transitory computer readable medium may store instructions on a memory coupled to a processor such that the instructions include functionality for operating the expandable downhole device. While the various steps in FIG. 10 are presented and described sequentially, one of ordinary skill in the art will appreciate that some or all of the steps may be executed in different orders, may be combined or omitted, and some or all of the steps may be executed in parallel.

In S1010, the expandable downhole device, in a compressed state, lowered to a specified depth in the wellbore. For example, hoisting equipment at a well site may be used to lower a tubing string in which the expandable downhole device is connected therein down the wellbore. Additionally, the expandable downhole device is in the compressed state by having the activation chamber in a first collapsed state and the shape memory foam in a compressed state below the glass transition temperature while RIH.

In S1020, when the expandable downhole device has reached the specified depth in the wellbore, the activation chamber is inflated to transition the expandable downhole device from the compressed state to an expanded state. For example, the activation chamber may be filled with a hydraulic fluid to a predetermined hydraulic pressure or a predetermined internal pressure to expand the activation chamber to a second activated state. A hydraulic line may be used to transport the hydraulic fluid from a hydraulic fluid source to the activation chamber. The hydraulic fluid source may be at the surface or within the tubing string. The predetermined internal pressure may be specified pressure required to plastically deform the activation chamber thereby expanding the activation chamber. To fill the activation chamber, the hydraulic fluid may be transported by a hydraulic line from a hydraulic fluid source (at the surface or downhole) to within the activation chamber.

In S1030, with the activation chamber in the second activated state, an expansion force is applied to the outer shroud. For example, with the activation chamber expanding, a radial force is exerted on the outer shroud from the activation chamber being beneath the outer shroud. The outer shroud is expanded into contact and to press against the wellbore. Additionally, as the outer shroud expands, the perforations of the outer shroud open to allow a stretching of the outer shroud. The perforations allow fluid to flow through the outer shroud in the expand state.

In S1040, the shape memory foam is expanded and harden to provide a support layer for the activation chamber. For example, the shape memory foam is heated at a wellbore temperature above a glass transition temperature. Once above the glass transition temperature, the shape memory foam will begin to into expand a void space adjacent to the shape memory foam or enlarge back into an original volume. For example, the shape memory foam may fill an annulus formed between the base pipe and the outer shroud.

In S1050, in the expanded states, the expandable downhole device supports the wellbore from collapsing. For example, the activation chamber and the support layer exert a radial force outwardly from the base pipe to press against the wellbore. This allows the expandable downhole device to support unconsolidated formations as well as irregular shaped wellbore. With the wellbore supported by the expandable downhole device, a fluid from the wellbore flows through perforations of the outer shroud. Additionally, the fluid may be filtered with a primary filter media of the expandable downhole device. The primary filter media may be the shape memory foam or a mesh screen to prevent a passage of particulates larger than a predefined size into the base pipe. Once filtered, the filtered fluid flows into an interior bore defined by the base pipe via fluid passageways of the base pipe.

In one or more embodiments, with the wellbore supported, the expandable downhole device may also allow a fluid flow from an exterior (e.g., the formation or wellbore) to an interior (e.g., a bore of a tubing string) or vice versa. When the fluid is flowing through the expandable downhole device, the fluid may undergo filtration operations. For example, the fluid may flow through the perforations of the outer shroud and be filtered, by the shape memory foam or a metal weave. The shape memory foam or the metal weave may filter the fluids to prevent a passage of particulates larger than a predefined size into the base pipe of the expandable downhole device in fluid communication with the bore of the tubing string.

Examples of the above aspects include:

Example 1 is an expandable downhole device for supporting a wellbore comprising: a base pipe defining an interior bore, the base pipe comprising fluid passageways configured to provide fluid communication between an exterior of the base pipe and the interior bore; an outer shroud disposed around the base pipe, the outer shroud comprising perforations configured to allow fluid communication of a fluid through the outer shroud; an activation chamber disposed between the base pipe and the outer shroud; and a shape memory foam in contact with the activation chamber or the outer shroud, wherein the outer shroud, the activation chamber, and the shape memory foam are configured to transition from a compressed state to an expanded state in response to a predetermined condition, and wherein in the expanded state, the activation chamber and the shape memory foam are configured to support the wellbore from collapsing.

Example 2 includes the aspects of any preceding examples or combinations thereof and further includes the expandable downhole device of example 1, wherein the predetermined condition comprises a predetermined hydraulic pressure to expand the activation chamber and a predetermined wellbore temperature to expand and harden the shape memory foam.

Example 3 includes the aspects of any preceding examples or combinations thereof and further includes the expandable downhole device of example 1, wherein the shape memory foam is disposed around the base pipe, is a filter media to filter the fluid flowing from the exterior of the base pipe to the interior bore, and is configured to expand and harden within an annulus formed between the base pipe and the outer shroud.

Example 4 includes the aspects of any preceding examples or combinations thereof and further includes the expandable downhole device of example 1, further comprising a filter media disposed in an annulus formed between the base pipe and the outer shroud and configured to filter the fluid flowing from the exterior of the base pipe to the interior bore.

Example 5 includes the aspects of any preceding examples or combinations thereof and further includes he expandable downhole device of example 1, wherein the activation chamber is configured to expand and press the outer shroud against a wellbore wall to support the wellbore.

Example 6 includes the aspects of any preceding examples or combinations thereof and further includes the expandable downhole device of example 1, wherein the shape memory foam is disposed between the activation chamber and the outer shroud or between the activation chamber and the base pipe.

Example 7 includes the aspects of any preceding examples or combinations thereof and further includes the expandable downhole device of example 1, further comprising a hydraulic line fluidly connecting the activation chamber to a hydraulic fluid source configured to expand the activation chamber.

Example 8 is a method for supporting a wellbore with an expandable downhole device, the method comprising: lowering, in a compressed state, the expandable downhole device to a depth in the wellbore with a tubing string, wherein a base pipe of the expandable downhole device is connected in the tubing string; inflating an activation chamber of the expandable downhole device to transition the expandable downhole device from the compressed state to an expanded state, the activation chamber is configured to expand an outer shroud disposed around the base pipe to press against the wellbore; expanding and hardening a shape memory foam of the expandable downhole device to support the activation chamber; and supporting the wellbore with the activation chamber and the shape memory foam in the expanded state from collapsing.

Example 9 includes the aspects of any preceding examples or combinations thereof and further includes the method of example 8, wherein inflating the activation chamber further comprises filling the activation chamber with a hydraulic fluid to expand the activation chamber.

Example 10 includes the aspects of any preceding examples or combinations thereof and further includes the method of example 8, wherein expanding and hardening the shape memory foam further comprises heating the shape memory foam with a wellbore temperature above a glass transition temperature of the shape memory foam.

Example 11 includes the aspects of any preceding examples or combinations thereof and further includes the method of example 8, further comprising: flowing a fluid from the wellbore through perforations of the outer shroud; filtering the fluid with the shape memory foam to prevent a passage of particulates larger than a predefined size into the base pipe; and flowing the filtered fluid into an interior bore defined by the base pipe via fluid passageways of the base pipe.

Example 12 includes the aspects of any preceding examples or combinations thereof and further includes the method of example 11, further comprising filling an annulus formed between the base pipe, the outer shroud, and the activation chamber with the shape memory foam.

Example 13 includes the aspects of any preceding examples or combinations thereof and further includes the method of example 8, further comprising: flowing a fluid from the wellbore flowing through perforations of the outer shroud; filtering the fluid with a filter media to prevent a passage of particulates larger than a predefined size into the base pipe, wherein filter media is disposed in an annulus formed between the base pipe and the outer shroud; and flowing the filtered fluid into an interior bore defined by the base pipe via fluid passageways of the base pipe.

Example 14 includes the aspects of any preceding examples or combinations thereof and further includes the method of example 8, wherein the shape memory foam is disposed between the activation chamber and the outer shroud or between the activation chamber and the base pipe.

Example 15 includes the aspects of any preceding examples or combinations thereof and further includes the method of example 8, further comprising transporting, with a hydraulic line, a hydraulic fluid from a hydraulic fluid source to within the activation chamber to expand the activation chamber.

Example 16 is a system comprising: a tubing string within a wellbore; a base pipe connected in the tubing string, the base pipe defining an interior bore and comprising fluid passageways configured to provide fluid communication between the wellbore and the interior bore; an outer shroud disposed around the base pipe, the outer shroud comprising perforations configured to allow fluid communication of a fluid from the wellbore through the outer shroud; an activation chamber disposed between the base pipe and the outer shroud; and a shape memory foam in contact with the activation chamber or the outer shroud, wherein the outer shroud, the activation chamber, and the shape memory foam are configured to transition from a compressed state to an expanded state in response to a predetermined condition at a predetermined depth in the wellbore, wherein in the expanded state, the outer shroud is expanded into contact with the wellbore, the activation chamber and the shape memory foam are configured support the wellbore from collapsing, and the shape memory foam is configured to be a filter media to filter the fluid flowing through the outer shroud and into the interior bore.

Example 17 includes the aspects of any preceding examples or combinations thereof and further includes the system of example 16, wherein the predetermined condition comprises a predetermined hydraulic pressure to expand the activation chamber and a predetermined wellbore temperature to expand and harden the shape memory foam.

Example 18 includes the aspects of any preceding examples or combinations thereof and further includes the system of example 16, wherein the shape memory foam is disposed around the base pipe and is configured to expand and harden within an annulus formed between the base pipe and the outer shroud.

Example 19 includes the aspects of any preceding examples or combinations thereof and further includes the system of example 16, further comprising a second filter media disposed in an annulus formed between the base pipe and the outer shroud and configured to filter the fluid flowing from an exterior of the base pipe to the interior bore.

Example 20 includes the aspects of any preceding examples or combinations thereof and further includes the system of example 16, further comprising a hydraulic line fluidly connecting the activation chamber to a hydraulic fluid source.

Certain terms are used throughout the description and claims to refer to particular features or components. As one skilled in the art will appreciate, different persons may refer to the same feature or component by different names. This document does not intend to distinguish between components or features that differ in name but not function. It is to be further understood that the various embodiments described herein may be used in various stages of a well (land and/or offshore), such as rig site preparation, drilling, completion, abandonment etc., and in other environments, such as work-over rigs, fracking installation, well-testing installation, oil and gas production installation, without departing from the scope of the present disclosure. Wherever possible, like or identical reference numerals are used in the figures to identify common or the same elements. The figures are not necessarily to scale and certain features and certain views of the figures may be shown exaggerated in scale for purposes of clarification.

For the aspects and examples above, a non-transitory computer readable medium can comprise instructions stored thereon, which, when performed by a machine, cause the machine to perform operations, the operations comprising one or more features similar or identical to features of methods and techniques described above. The physical structures of such instructions may be operated on by one or more processors. A system to implement the described algorithm may also include an electronic apparatus and a communications unit. The system may also include a bus, where the bus provides electrical conductivity among the components of the system. The bus can include an address bus, a data bus, and a control bus, each independently configured. The bus can also use common conductive lines for providing one or more of address, data, or control, the use of which can be regulated by the one or more processors. The bus can be configured such that the components of the system can be distributed. The bus may also be arranged as part of a communication network allowing communication with control sites situated remotely from system.

In various aspects of the system, peripheral devices such as displays, additional storage memory, and/or other control devices that may operate in conjunction with the one or more processors and/or the memory modules. The peripheral devices can be arranged to operate in conjunction with display unit(s) with instructions stored in the memory module to implement the user interface to manage the display of information. Such a user interface can be operated in conjunction with the communications unit and the bus. Various components of the system can be integrated such that processing identical to or similar to the processing schemes discussed with respect to various aspects herein can be performed.

While descriptions herein may relate to "comprising" various components or steps, the descriptions can also "consist essentially of" or "consist of" the various components and steps.

Unless otherwise indicated, all numbers expressing quantities are to be understood as being modified in all instances by the term "about" or "approximately". Accordingly, unless indicated to the contrary, the numerical parameters are approximations that may vary depending upon the properties of the present disclosure. As used herein, "about", "approximately", "substantially", and "significantly" will be understood by persons of ordinary skill in the art and will vary to some extent on the context in which they are used. If there are uses of the term which are not clear to persons of ordinary skill in the art given the context in which it is used, "about" and "approximately" will mean plus or minus 10% of the particular term and "substantially" and "significantly" will mean plus or minus 5% of the particular term.

The aspects disclosed should not be interpreted, or otherwise used, as limiting the scope of the disclosure, including the claims. It is to be fully recognized that the different teachings of the aspects discussed may be employed separately or in any suitable combination to produce results. In addition, one skilled in the art will understand that the description has broad application, and the discussion of any aspect is meant only to be exemplary of that aspect, and not intended to suggest that the scope of the disclosure, including the claims, is limited to that aspect.

What is claimed is:

1. An expandable downhole device for supporting a wellbore comprising:

a base pipe defining an interior bore, the base pipe comprising fluid passageways configured to provide fluid communication between an exterior of the base pipe and the interior bore;

an outer shroud disposed around the base pipe, the outer shroud comprising perforations configured to allow fluid communication of a fluid through the outer shroud;

an activation chamber disposed between the base pipe and the outer shroud; and a shape memory foam disposed in an annulus between the base pipe and the outer shroud, the shape memory foam being positioned adjacent to the activation chamber, wherein the activation chamber is configured to expand in response to a predetermined condition to transition the outer shroud from a compressed state to an expanded state to press the outer shroud against a wellbore wall, and wherein the shape memory foam is configured to expand and harden in the expanded state to provide support to the outer shroud.

2. The expandable downhole device of claim 1, wherein the predetermined condition comprises a predetermined hydraulic pressure to expand the activation chamber and a predetermined wellbore temperature to expand and harden the shape memory foam.

3. The expandable downhole device of claim 1, wherein the shape memory foam is a filter media to filter the fluid flowing from the exterior of the base pipe to the interior bore.

4. The expandable downhole device of claim 1, further comprising a filter media disposed in the annulus formed between the base pipe and the outer shroud and configured to filter the fluid flowing from the exterior of the base pipe to the interior bore.

5. The expandable downhole device of claim 1, wherein the activation chamber is configured to expand and press the outer shroud against a wellbore wall to support the wellbore.

6. The expandable downhole device of claim 1, wherein the shape memory foam is disposed between the activation chamber and the outer shroud or between the activation chamber and the base pipe.

7. The expandable downhole device of claim 1, further comprising a hydraulic line fluidly connecting the activation chamber to a hydraulic fluid source configured to expand the activation chamber.

8. A method for supporting a wellbore with an expandable downhole device, the method comprising:

lowering, in a compressed state, the expandable downhole device to a depth in the wellbore with a tubing string, wherein a base pipe of the expandable downhole device is connected in the tubing string;

inflating an activation chamber of the expandable downhole device to transition the expandable downhole device from the compressed state to an expanded state, the activation chamber being configured to expand an outer shroud disposed around the base pipe to press the outer shroud against a wellbore wall;

expanding and hardening a shape memory foam disposed in an annulus between the base pipe and the outer shroud and positioned adjacent to the activation chamber; and supporting the outer shroud in the expanded state with the shape memory foam.

9. The method of claim 8, wherein inflating the activation chamber further comprises filling the activation chamber with a hydraulic fluid to expand the activation chamber.

10. The method of claim 8, wherein expanding and hardening the shape memory foam further comprises heating the shape memory foam with a wellbore temperature above a glass transition temperature of the shape memory foam.

11. The method of claim 8, further comprising:

flowing a fluid from the wellbore through perforations of the outer shroud;

filtering the fluid with the shape memory foam to prevent a passage of particulates larger than a predefined size into the base pipe; and flowing the filtered fluid into an interior bore defined by the base pipe via fluid passageways of the base pipe.

12. The method of claim 11, further comprising filling space in the annulus formed between the base pipe and the outer shroud with the shape memory foam.

13. The method of claim 8, further comprising:

flowing a fluid from the wellbore flowing through perforations of the outer shroud;

filtering the fluid with a filter media to prevent a passage of particulates larger than a predefined size into the base pipe, wherein filter media is disposed in the annulus formed between the base pipe and the outer shroud; and flowing the filtered fluid into an interior bore defined by the base pipe via fluid passageways of the base pipe.

14. The method of claim 8, wherein the shape memory foam is disposed between the activation chamber and the outer shroud or between the activation chamber and the base pipe.

15. The method of claim 8, further comprising transporting, with a hydraulic line, a hydraulic fluid from a hydraulic fluid source to within the activation chamber to expand the activation chamber.

16. A system comprising:

a tubing string within a wellbore;

a base pipe connected in the tubing string, the base pipe defining an interior bore and comprising fluid passageways configured to provide fluid communication between the wellbore and the interior bore;

an outer shroud disposed around the base pipe, the outer shroud comprising perforations configured to allow fluid communication of a fluid from the wellbore through the outer shroud;

an activation chamber disposed between the base pipe and the outer shroud; and a shape memory foam disposed in an annulus between the base pipe and the outer shroud, the shape memory foam being positioned adjacent to the activation chamber, wherein the activation chamber is configured to expand in response to a predetermined condition to transition the outer shroud from a compressed state to an expanded state to press the outer shroud against a wellbore wall, wherein the shape memory foam is configured to expand and harden in the expanded state to provide support to the outer shroud.

17. The system of claim 16, wherein the predetermined condition comprises a predetermined hydraulic pressure to expand the activation chamber and a predetermined wellbore temperature to expand and harden the shape memory foam.

18. The system of claim 16, wherein the shape memory foam is configured to be a filter media to filter the fluid flowing through the outer shroud and into the interior bore.

19. The system of claim 18, further comprising a second filter media disposed in the annulus formed between the base pipe and the outer shroud and configured to filter the fluid flowing from an exterior of the base pipe to the interior bore.

20. The system of claim 16, further comprising a hydraulic line fluidly connecting the activation chamber to a hydraulic fluid source.

* * * * *